United States Patent [19]

Fretz et al.

[11] Patent Number: 4,695,000

[45] Date of Patent: Sep. 22, 1987

[54] DEVICE FOR WINDING-UP A THREAD

[75] Inventors: Walter Fretz, Freienstein; Walter Hefti, Ettenhausen, both of Switzerland

[73] Assignee: Maschinenfabrik Rieter AG, Winterthur, Switzerland

[21] Appl. No.: 7,579

[22] Filed: Jan. 28, 1987

[30] Foreign Application Priority Data

Jan. 29, 1986 [CH] Switzerland ..... 00343/86

[51] Int. Cl.[4] ..... B65H 54/46

[52] U.S. Cl. ..... 242/18 DD

[58] Field of Search ..... 242/18 DD

[56] References Cited

U.S. PATENT DOCUMENTS 492,613 2/1893 Pierce ..... 242/18 DD
1,277,933 9/1918 Holt et al. ..... 242/18 DD
4,089,480 5/1978 Kamp ..... 242/18 DD
4,415,125 11/1983 Schwengeler ..... 242/18 DD

*Primary Examiner*—Stanley N. Gilreath
*Attorney, Agent, or Firm*—Werner W. Kleeman

[57] ABSTRACT

A device for winding up a thread or yarn or the like into a yarn package on a rotatable, conical bobbin tube comprises a drive roller which has an intermediate rotational element fixedly coupled to a drive shaft and two lateral rotational elements disposed laterally of the fixedly coupled intermediate rotational element and rotatably supported on the drive shaft. The lateral rotational elements are interconnected by a differential transmission. The differential transmission comprises a friction coupling. This affords the advantage of a strong reduction in the danger of damage to the yarn package in the event of blockage of one of the lateral rotational elements. Furthermore, the results of faulty manipulation of the drive roller during servicing or maintenance thereof is very substantially reduced.

12 Claims, 1 Drawing Figure

DEVICE FOR WINDING-UP A THREAD

BACKGROUND OF THE INVENTION

The present invention broadly relates to a new and improved device for winding-up a thread or yarn or the like to form a yarn package on a rotatable conical bobbin tube or the like by means of a rotatable drive roller.

Generally speaking, the device for winding-up filamentary materials, such as a thread or yarn or the like to form a yarn package on a rotatable conical bobbin tube by means of a rotatable drive roller or roll comprises substantially cylindrical rotational elements arranged axially adjacent to one another on a common drive shaft. The central or intermediate rotational element of these rotational elements is fixedly secured to the drive shaft and at each end of this central or intermediate rotational element there is arranged a lateral rotational element on a respective therewith operatively associated rotational bearing located on the drive shaft. The rotational elements contactingly engage with the bobbin tube or yarn package formed thereon, as the case may be, along a contact line or generatrix for rolling engagement therewith during the yarn wind-up operation. The lateral rotational elements are connected together or interconnected by a differential transmission.

Such a device is already known from European Patent Publication No. 63,690. In accordance with the device shown and described in that patent, friction and rubbing of the drive roller or roll on the yarn packages is strongly reduced and a wound-up yarn is obtained with even yarn tension.

However, it has been found in practice that the lateral rotational elements provided in accordance with such European Patent Publication No. 63,690 can jam with the central rotational element. The main cause of such jamming is that contamination or soiling can arise between the central rotational element and the lateral rotational elements as a result of the accumulation therebetween of fibers, yarn particles, dust and the like. If jamming arises, one of these lateral rotational elements rotates with a too high or a too low rotational speed and forces the other lateral rotational element to rotate with a too low or a too high rotational speed, as the case may be, since the two lateral rotational elements are fixedly secured to each other. Under such conditions, the drive roll exerts a pronounced rubbing effect or scuffing action on the yarn package to be wound, so that damage to the yarn or the like can arise.

In the event of such jamming, an attempt is generally made to free the system by forced rotation of the blocked cylinder or rotational element. Since, in the known drive rolls, the gear wheels of the differential transmission are made from plastic material for several reasons, there exists a further disadvantage in that during such forced rotation of the blocked cylinder or rotational element, due to a false manipulation the non-jammed or non-blocked lateral cylinder or rotational element can also be fixedly grasped by the operator or repair work person upon holding of the drive roll. As a result, the teeth of the gear wheels of the differential transmission are often broken.

SUMMARY OF THE INVENTION

Therefore, with the foregoing in mind, it is a primary object of the present invention to provide a new and improved device for winding-up a filamentary material, such as a yarn or thread or the like to form a yarn package on a rotatable conical bobbin tube by means of a rotatable drive roller or roll which does not exhibit the aforesaid drawbacks and shortcomings of the prior art constructions.

Another and more specific object of the present invention concerns the provision of an improved device for winding-up a yarn or a thread in a highly efficient and reliable manner and which wind-up device contains a drive roller or roll which is so structured that it is not afflicted with the aforenoted shortcomings of the prior art.

Still a further important object of the present invention is directed to the provision of an improved construction of a filament winding-up device, for winding a yarn or thread or the like, which contains a uniquely constructed drive or friction roller or roll which is relatively simple in design, highly reliable in operation, not readily subject to breakdown or malfunction, requires a minimum of maintenance and servicing, and affords reliable and safe interaction between the lateral rotational elements of the drive or friction roller or roll for protection thereof against damage.

Now in order to implement these and still further objects of the invention, which will become more readily apparent as the description proceeds, the inventive yarn or thread winding-up device or winder is manifested by the features that the differential transmission serving for operatively coupling or interconnecting of the lateral rotational elements comprises a friction coupling.

BRIEF DESCRIPTION OF THE DRAWING

The invention will be better understood and objects other than those set forth above will become apparent when consideration is given to the following detailed description thereof. Such description makes reference to the annexed drawing wherein the single figure of the drawing shows a longitudinal section through a drive or friction roll constructed in accordance with the teachings of the present invention.

DETAILED DESCRIPTION OF THE PREFERRED EMBODIMENTS

Figure 1:
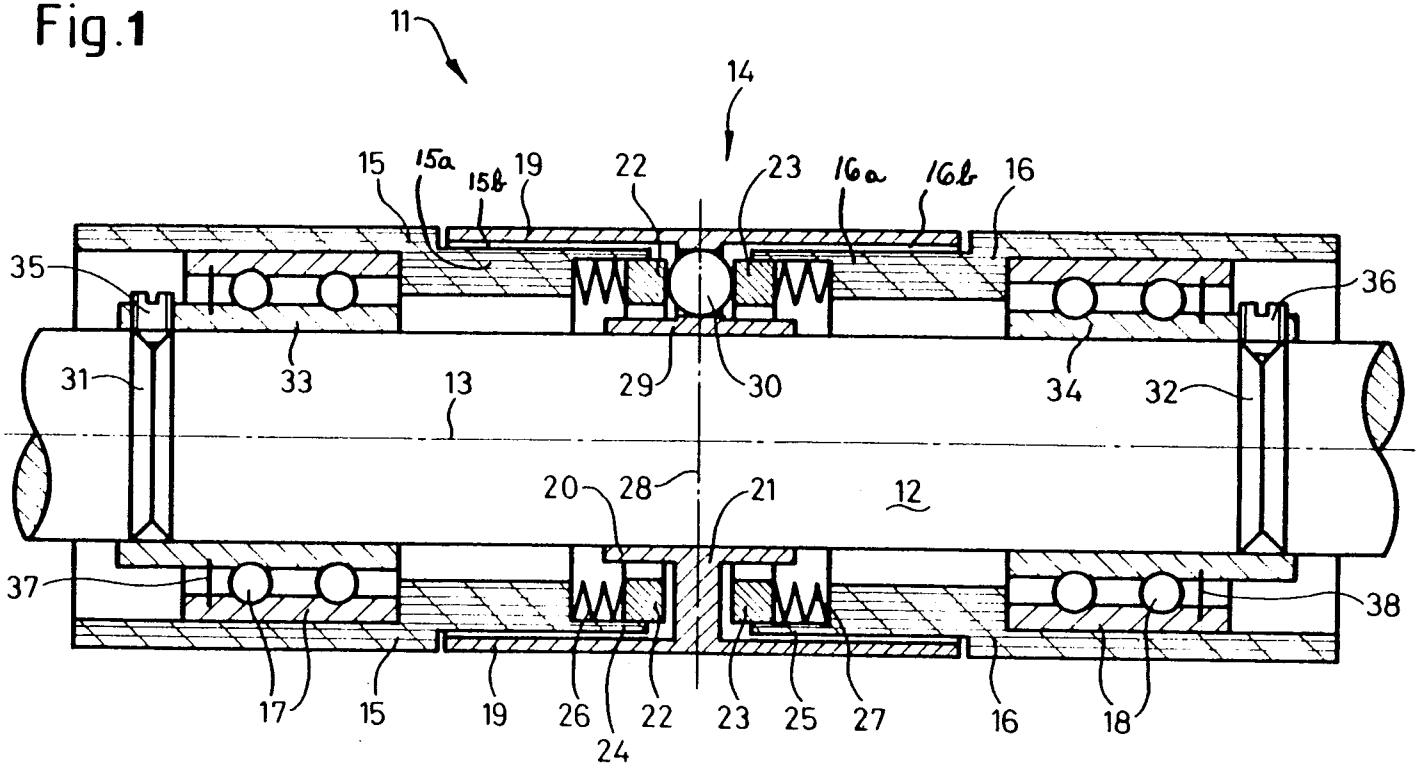

Describing now the drawings, it is to be understood that to simplify the showing thereof, only enough of the structure of the yarn or thread winding-up device for winding up filamentary materials, such as yarns or threads or the like—hereinafter generally simply conveniently referred to as a yarn or yarns—, and specifically the drive or friction roll thereof, has been illustrated therein as is needed to enable one skilled in the art to readily understand the underlying principles and concepts of the present invention. With reference to the use and the mode of operation of such a drive or friction roll during winding-up of a yarn or the like, reference is made to the aforementioned European Patent Publication No. 63,690 mentioned in the introduction of this disclosure.

Turning now specifically to the single FIG. 1 of the drawing, the drive or friction roller or roll 11 illustrated therein by way of example and not limitation, will be seen to comprise a drive shaft 12 having a longitudinal axis 13. A rotational element 14 is mounted on the drive shaft 12 and is fixed relative thereto. Adjoining this rotational element 14 at each end thereof, and which thus defines a central or intermediate rotational element, are two lateral rotational elements 15 and 16.

Each of these lateral rotational elements 15 and 16 is supported by an associated rotational bearing 17 and 18, respectively, and is rotatable about the drive shaft 12 which defines a common drive shaft for these substantially cylindrical rotational elements 14, 15 and 16. The central or intermediate rotational element 14 comprises two hollow cylinders or cylinder elements 19 and 20, defining outer and inner cylinders or cylinder elements, respectively, which are fixedly secured together by a connecting portion defining an intermediate section or web 21. All of these parts 15 to 21 are arranged coaxially with respect to the drive shaft 12. The intermediate section or web 21 has the form of an annular member or web arranged at substantially right angles to the longitudinal axis 13 of the drive shaft 12. The outer hollow cylinder 19 is relatively long and, as shown, thereby covers associated portions or parts 15*a* and 16*a* of the lateral rotational elements 15 and 16 while leaving a respective intermediate space 15*b* and 16*b* therebetween. The intermediate section or annular web 21 which interconnects the outer hollow cylinder 19 and the inner hollow cylinder 20 forms a cage for one or more rolling elements or bodies 30.

A substantially annular-shaped or ring-shaped abutment member 22 is secured to the lateral rotational element 15 for rotation therewith but is shiftable there along in axial direction. This annular-shaped or ring-shaped abutment member 22 is guided by virtue of its abutment or contact with the internal wall of the cylindrical portion 24 of the associated lateral rotational element 15. Moreover, such annular-shaped or ring-shaped abutment member 22 is biased by a compression spring 26 towards the central or intermediate plane 28 which separates the drive or friction roller or roll 11 into two halves. In a similar manner, a substantially annular-shaped or ring-shaped abutment member 23 and a compression spring 27 are provided on the cylindrical portion 25 of the other lateral rotational element 16 and they perform similar functions to the parts 22, 24 and 26.

Three guides or guide members 29 are provided in the intermediate section or web 21 for three rolling elements or bodies 30 formed as spheres or balls; in the single Figure, only one such sphere or ball 30 provided in its associated guide or guide member 29 is visible in the drawing to simplify the illustration. The centers of these spheres or balls 30 are located at uniform mutual spacings form each other on a non-illustrated circle which is disposed coaxial with respect to the drive shaft 12 i.e. the longitudinal or lengthwise axis 13 thereof. The diameter of this circle is equal to the average diameters of the annular-shaped or ring-shaped abutment members 22 and 23. The expression "average diameter" refers to the diameter of the circles formed by the centers of the cross-sections of the annular-shaped or ring-shaped abutment members 22 and 23, respectively. Thus, these ring-shaped abutment members 22 and 23 are biased towards the rolling elements or bodies 30 by the compression springs 26 and 27.

Finally, two annular grooves 31 and 32 are provided in the drive shaft 12. Screws 35 and 36 or other suitable fixing means are provided in the inner races or rings 33 and 34 of the rotational bearings 17 and 18 and serve to fix these inner races 33 and 34 and thus to determine the position of these rotational bearings 17 and 18 in the axial direction and to provide a predeterminate bias by means of the compression springs 26 and 27 to the annular-shaped abutment members 22 and 23. Suitable seals 37 and 38 serve to prevent penetration of dust into the rotational bearings 17 and 18.

Static friction is created between the rolling elements or bodies 30 and the abutment members 22 and 23 pressed against them. Thus, these rolling elements or bodies 30 form a friction coupling of a differential transmission. In this way, a rotational moment or torque is transmitted from one of the lateral rotational elements, for example the lateral rotational element 15, to the other lateral rotational element 16 via the individual parts 22, 23 and 30. Thus, sliding motion or movement is possible between the abutment members 22 and 23 and the spheres or balls 30.

If an operation must be performed on the drive or friction roller or roll 11 in the event of a fault or malfunction, or if the rotational moment acting upon the friction coupling exceeds a certain value in the event of blockage of the lateral rotational elements 15 and 16, then sliding occurs between the parts 22, 23 and 30, so that in contrast to the known prior art arrangement, damage to the yarn or thread of the package to be wound up and/or destruction of the coupling parts, is advantageously avoided.

In the present embodiment, three rolling bodies, i.e. spheres or balls 30 are provided. The advantage of this embodiment is that the abutment members 22 and 23 rest evenly on all three rolling bodies 30 and are thus stable. It is to be understood, however, that more than three rolling bodies 30 can be provided. Since, on the other hand, the annular-shaped abutment members 22 and 23 are guided by the cylindrical portions 24 and 25, and a tilting movement thereof is prevented, only two rolling bodies (or in an extreme case only one such rolling body) could be provided.

The start of the sliding action can be selected as required, and can be set by suitable choice of the compression springs 26 and 27, that is, by selection of a suitable resilient bias. The provision of the grooves or annular depressions 31 and 32 enables exact positioning of the rotational bearings 17 and 18, (and thus the rotational elements 15 and 16) in the axial direction of the drive shaft 12 by means of the screws 35 and 36, respectively, passing through the inner races or rings 33 and 34, respectively. In this way, it is ensured that the resilient bias does not have to be newly-set after each operation of the drive roller or roll 11. Packets of cup springs (e.g. Belleville washers) have proved especially suitable for use as the compression springs 26 and 27.

When sliding or sliding motion arises in the friction coupling, the members 22 and 30 and/or 23 and 30 slide on each other. It is clear that sliding motion between only two individual parts, that is at only one position, is adequate to avoid damage to the drive roller or roll 11.

Spheres or balls 30 are provided in the illustrated example as the rolling bodies. Cylindrical or conically-shaped rolling bodies could be provided in place of the spheres or balls 30, the rotational axes being disposed radially with respect to the drive shaft 12 (as is the case for the illustrated, ball-shaped rolling bodies 30).

Covering of the portions or parts 15*a* and 16*a* of the lateral rotational elements 15 and 16, respectively, facing towards the central or intermediate rotational element 14 by the outer hollow cylinder 19 provides the advantage that dust particles, fibers and the like pass to a greatly reduced extent into the interior of the drive roller or roll 11, that is into the friction coupling portion thereof. This covering action thus provides an advantageous means to achieve improved protection against contamination or fouling of the lateral rotational elements 15 and 16. Contamination or fouling can be still further reduced by provision of ribs, for moving or displacing the dirt outwardly, in the respective intermediate space 15*a* and 15*b* between the outer hollow cylinder 19 and the portions or parts 15*a* and 16*a* of the lateral rotational elements 15 and 16 covered thereby.

While there are shown and described present preferred embodiments of the invention, it is to be distinctly understood that the invention is not limited thereto, but may be otherwise variously embodied and practiced within the scope of the following claims. Accordingly,

What we claim is:

1. In a device for winding-up a yarn to form a yarn package on a rotatable conical bobbin tube by means of a rotatable drive roller, comprising:

a common drive shaft;

substantially cylindrical rotational elements arranged axially adjacent one another on said common drive shaft;

said substantially cylindrical rotational elements defining a central rotational element and two lateral rotational elements;

said central rotational element having oppositely situated ends;

said central rotational element being fixedly secured to the drive shaft;

a given one of said two lateral rotational elements being arranged at each end of the central rotational element;

a rotational bearing provided for each lateral rotational element for mounting each said lateral rotational element upon said drive shaft;

said rotational elements being capable of engaging with the bobbin tube or yarn package being formed thereon along a generatrix for rolling engagement therewith during a yarn wind-up operation;

a differential transmission for operatively interconnecting said lateral rotational elements; and said differential transmission serving for operatively interconnecting said lateral rotational elements comprises a friction coupling.

2. The device for winding-up a yarn as defined in claim 1, wherein:

said friction coupling serves to transmit a torque from one lateral rotational element to the other lateral rotational element;

said friction coupling comprising at least two components between which there occurs a sliding motion; and said two components serving for transmitting said torque from said one lateral rotational element to said other lateral rotational element.

3. The device for winding-up a yarn as defined in claim 1, wherein:

said friction coupling comprises at least one rolling body for transmission of a rotational moment from one of said lateral rotational elements to the other one of said lateral rotational elements.

4. The device for winding-up a yarn as defined in claim 3, wherein:

said friction coupling comprises a respective abutment member for each said lateral rotational element;

said at least one rolling body is rotatably guided in said central rotational element;

each said lateral rotational element being rotationally connected to a respective one of said abutment members; and means for resiliently biasing each said abutment member towards said rolling body.

5. The device for winding-up a yarn as defined in claim 4, wherein:

three of said rolling bodies are provided which are arranged at substantially mutually equal spacings from each other on a circle disposed substantially coaxial to said drive shaft;

said abutment member of each said lateral rotational element defining a substantially annular-shaped abutment member disposed substantially coaxial to said drive shaft;

each said substantially annular-shaped abutment member having an average diameter which is substantially equal to the diameter of said coaxial circle; and said means for resiliently biasing each said abutment member biasing each said abutment member towards said three rolling bodies.

6. The device for winding-up a yarn as defined in claim 5, wherein:

said biasing means for each said abutment member comprises a packet of cup springs which engage said abutment member.

7. The device for winding-up a yarn as defined in claim 4, wherein:

said rolling body is a ball member.

8. The device for winding-up a yarn as defined in claim 1, wherein:

said central rotational element comprises a hollow cylinder arranged substantially coaxial to said drive shaft;

said hollow cylinder having oppositely situated end portions; and each end portion of said hollow cylinder extending over an associated portion of a related one of said lateral rotational elements and covering said related one of said lateral rotational elements while leaving therebetween a small intervening space.

9. The device for winding-up a yarn as defined in claim 4, wherein:

said central rotational element comprises an outer hollow cylinder and an inner hollow cylinder arranged substantially coaxial to said drive shaft;

a connecting portion for fixedly interconnecting said outer hollow cylinder and said inner hollow cylinder to one another; and said connecting portion defining a substantially annular web which is disposed between said outer hollow cylinder and said inner hollow cylinder and extends at substantially right angles to said drive shaft and forms a cage for receiving said rolling body.

10. The device for winding-up a yarn as defined in claim 4, further including:

means for fixing said rotational bearings on said drive shaft at a spacing, in axial direction of said drive shaft, from said rolling body in order to provide a predeterminate resilient bias to said abutment members.

11. The device for winding-up a yarn as defined in claim 10, wherein:

each of said rotational bearing has an inner race; and said fixing means serving to fix said inner races of said rotational bearings to said drive shaft.

12. The device for winding-up a yarn as defined in claim 11, wherein:

said drive shaft is provided with groove means; and said fixing means comprise screws which extend into said groove means of said drive shaft.

* * * * *

UNITED STATES PATENT AND TRADEMARK OFFICE

CERTIFICATE OF CORRECTION

PATENT NO. : 4,695,000

DATED : September 22, 1987

INVENTOR(S) : Walter FRETZ et al

It is certified that error appears in the above-identified patent and that said Letters Patent is hereby corrected as shown below:

Page 1, Section [21], please replace "7,579" by --007,579--

Signed and Sealed this

Twenty-ninth Day of March, 1988

*Attest:*

DONALD J. QUIGG

*Attesting Officer*

*Commissioner of Patents and Trademarks*